US009437168B2

(12) United States Patent
Her

(10) Patent No.: US 9,437,168 B2
(45) Date of Patent: Sep. 6, 2016

(54) GATE DRIVING CIRCUIT AND DISPLAY DEVICE INCLUDING THE SAME

(71) Applicant: Samsung Display Co., Ltd., Yongin, Gyeonggi-Do (KR)

(72) Inventor: Yong-Koo Her, Yongin-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 0 days.

(21) Appl. No.: 14/535,066

(22) Filed: Nov. 6, 2014

(65) Prior Publication Data

US 2015/0348508 A1 Dec. 3, 2015

(30) Foreign Application Priority Data

May 27, 2014 (KR) ..... 10-2014-0063639

(51) Int. Cl.

| | |
|---|---|
| ***G09G 5/18*** | (2006.01) |
| ***G09G 3/32*** | (2016.01) |
| ***G09G 3/36*** | (2006.01) |
| ***G09G 3/20*** | (2006.01) |

(52) U.S. Cl.

CPC *G09G 5/18* (2013.01); *G09G 3/20* (2013.01); *G09G 3/3225* (2013.01); *G09G 3/3266* (2013.01); *G09G 3/3677* (2013.01); *G09G 2310/0267* (2013.01); *G09G 2310/04* (2013.01); *G09G 2380/02* (2013.01)

(58) Field of Classification Search

CPC ..... G06F 3/0412; G09G 5/18

See application file for complete search history.

(56) References Cited

U.S. PATENT DOCUMENTS

| | | | | |
|---|---|---|---|---|
| 2012/0038613 | A1 | 2/2012 | Choi | |
| 2012/0327064 | A1 | 12/2012 | Qi et al. | |
| 2013/0088479 | A1* | 4/2013 | Kim | G09G 3/3614 345/212 |
| 2013/0285888 | A1* | 10/2013 | Chung | G11C 19/28 345/55 |
| 2015/0138736 | A1* | 5/2015 | Catchpole | G06F 1/1652 361/749 |

FOREIGN PATENT DOCUMENTS

| | | | |
|---|---|---|---|
| KR | 10-2012-0015890 | A | 2/2012 |
| KR | 10-2012-0106662 | A | 9/2012 |
| KR | 10-2014-0025231 | A | 3/2014 |

* cited by examiner

*Primary Examiner* — Kathy Wang-Hurst
*Assistant Examiner* — Peijie Shen
(74) *Attorney, Agent, or Firm* — Knobbe Martens Olson & Bear LLP

(57) ABSTRACT

A gate driving circuit and display device including the same are disclosed. In one aspect, the gate driving circuit includes a plurality of stages, each stage including a first input portion configured to apply an input signal to a first node based on a first clock signal, a first output portion configured to output a second clock signal as a gate output signal based on a first node signal applied to the first node, a second input portion configured to apply the first clock signal to a second node based on the first node signal, a second output portion configured to output a first voltage as the gate output signal based on a second node signal applied to the second node, and an output control portion configured to activate the first output portion based on an output control signal.

17 Claims, 8 Drawing Sheets

GATE DRIVING CIRCUIT AND DISPLAY DEVICE INCLUDING THE SAME

INCORPORATION BY REFERENCE TO ANY PRIORITY APPLICATIONS

This application claims priority under 35 USC §119 to Korean Patent Application No. 10-2014-0063639, filed on May 27, 2014 in the Korean Intellectual Property Office (KIPO), the contents of which are incorporated herein in its entirety by reference.

BACKGROUND

1. Field

The described technology generally relates to a gate driving circuit and a display device including the same.

2. Description of the Related Technology

Generally, display devices include a display panel and a driver. The display panel includes a plurality of gate lines, a plurality of data lines, and a plurality of pixels. The driver includes a gate driving circuit transmitting gate output signals to the gate lines and a data driving circuit transmitting data voltages to the data lines. The date driving circuit includes a plurality of stages outputting gate output signals.

SUMMARY OF CERTAIN INVENTIVE ASPECTS

One inventive aspect is a gate driving circuit for controlling the gate output signal.

Another aspect is a display device for reducing power consumption by having the gate driving circuit.

Another aspect is a gate driving circuit that can include a plurality of stages outputting a plurality of gate output signals, respectively. An (N)th stage of the stages can include a first input part configured to apply an input signal to a first node in response to a first clock signal, a first output part configured to output a second clock signal as an (N)th gate output signal in response to a first node signal applied to the first node, a second input part configured to apply the first clock signal to a second node in response to the first node signal, a second output part configured to output a first voltage as the (N)th gate output signal in response to a second node signal applied to the second node, and an output control part configured to activate the first output part in response to an output control signal, where N is a positive integer.

In example embodiments, the (N)th stage can further includes a stabilizing part configured to stabilize the (N)th gate output signal in response to the second node signal and the second clock signal.

In example embodiments, the stabilizing part can include a first stabilizing transistor and a second stabilizing transistor that are connected to each other in series. The first stabilizing transistor can include a gate electrode connected to the second node, a source electrode to which the first voltage is applied, and a drain electrode connected to a source electrode of the second stabilizing transistor. The second stabilizing transistor can include a gate electrode to which the second clock signal is applied, the source electrode connected to the drain electrode of the first stabilizing transistor, and a drain electrode connected to the first node.

In example embodiments, the (N)th stage can further include a holding part configured to maintain the second node signal in response to the first clock signal.

In example embodiments, the first clock signal and the second clock signal can have a second logic level when the output control signal has a first logic level.

Another aspect is a display device comprising that can include a display panel including a plurality of gate lines, a plurality of data lines crossing the gate lines, and a plurality of pixels, a data driving circuit configured to output a plurality of data signals to the data lines, respectively, a gate driving circuit including a plurality of stages and configured to output a plurality of gate output signals to the gate lines, respectively, and a timing control unit configured to control the gate driving circuit and the data driving circuit. An (N)th stage of the stages included in the gate driving circuit, where N is a positive integer, can include a first input part configured to apply an input signal to a first node in response to a first clock signal, a first output part configured to output a second clock signal as an (N)th gate output signal in response to a first node signal applied to the first node, a second input part configured to apply the first clock signal to a second node in response to the first node signal, a second output part configured to output a first voltage as the (N)th gate output signal in response to a second node signal applied to the second node, and an output control part configured to activate the first output part in response to an output control signal.

In example embodiments, the display panel can be a foldable display panel that is folded along at least one folding line.

In example embodiments, the timing control unit can output the output control signal having a first logic level and outputs the first and second clock signals having a second logic level in non-display stages corresponding to a non-display region of the foldable display panel when the display panel is folded.

In example embodiments, the display panel can be a flexible display panel.

In example embodiments, the display device can further include a flexible detection unit configured to detect a non-display region of the flexible display panel and to provide non-display region information relating to the non-display region to the timing control unit. The timing control unit can output the output control signal having a first logic level and outputs the first and second clock signals having a second logic level in non-display stages corresponding to the non-display region using the non-display region information.

In example embodiments, the timing control unit can output the output control signal having a first logic level and outputs the first and second clock signals having a second logic level during a predetermined non-display period when image data included in the data signals are still image data.

In example embodiments, the (N)th stage can further include a stabilizing part configured to stabilize the (N)th gate output signal in response to the second node signal and the second clock signal.

In example embodiments, the (N)th stage can further include a stabilizing part configured to stabilize the (N)th gate output signal in response to the second node signal and the second clock signal.

In example embodiments, the stabilizing part can include a first stabilizing transistor and a second stabilizing transistor that are connected to each other in series. The first stabilizing transistor can include a gate electrode connected to the second node, a source electrode to which the first voltage is applied, and a drain electrode connected to a source electrode of the second stabilizing transistor. The second stabilizing transistor can include a gate electrode to which the second clock signal is applied, the source electrode connected to the drain electrode of the first stabilizing transistor, and a drain electrode connected to the first node.

In example embodiments, the (N)th stage can further include a holding part configured to maintain the second node signal in response to the first clock signal.

In example embodiments, the holding part can include a holding transistor. The holding transistor can include a gate electrode to which the first clock signal is applied, a source electrode to which a second voltage is applied, and a drain electrode connected to the second node.

In example embodiments, the first input part can include a first input transistor. The first input transistor can include a gate electrode to which the first clock signal is applied, a source electrode to which the input signal is applied, and a drain electrode connected to the first node.

In example embodiments, the first output part can include a first output transistor and a first capacitor. The first output transistor can include a gate electrode connected to the first node, a source electrode to which the second clock signal is applied, and a drain electrode connected to an output terminal that outputs the (N)th gate output signal. The first capacitor can include a first electrode connected to the first node and a second electrode connected to the output terminal.

In example embodiments, the second input part can include a second input transistor. The second input transistor can include a gate electrode connected to the first node, a source electrode to which the first clock signal is applied, and a drain electrode connected to the second node.

In example embodiments, the second output part can include a second output transistor and a second capacitor. The second output transistor can include a gate electrode connected to the second node, a source electrode to which the first voltage is applied, and a drain electrode connected to an output terminal that outputs the (N)th gate output signal. The second capacitor can include a first electrode connected to the second node and a second electrode to which the first voltage is applied.

In example embodiments, the output control part can include an output control transistor. The output control transistor can include a gate electrode to which the output control signal is applied, a source electrode to which a second voltage is applied, and a drain electrode connected to the first node.

Another aspect is a gate driving circuit for a display device, comprising a plurality of stages configured to respectively output a plurality of gate output signals. Each stage comprises a first input portion configured to apply an input signal to a first node based at least in part on a first clock signal, a first output portion configured to output a second clock signal as a gate output signal based at least in part on a first node signal applied to the first node, a second input portion configured to apply the first clock signal to a second node based at least in part on the first node signal, a second output portion configured to output a first voltage as the gate output signal based at least in part on a second node signal applied to the second node, and an output control portion configured to activate the first output portion based at least in part on an output control signal.

In the above circuit, an (N)th stage represents a selected stage among the stages, and wherein the (N)th stage further includes a stabilizing portion configured to substantially stabilize the (N)th gate output signal based at least in part on the second node signal and the second clock signal.

In the above circuit, the stabilizing portion includes first and second stabilizing transistors connected to each other in series, wherein the first stabilizing transistor includes a gate electrode connected to the second node, a source electrode to which the first voltage is applied, and a drain electrode connected to a source electrode of the second stabilizing transistor, and wherein the second stabilizing transistor includes a gate electrode to which the second clock signal is applied, the source electrode connected to the drain electrode of the first stabilizing transistor, and a drain electrode connected to the first node.

In the above circuit, an (N)th stage represents a selected stage among the stages, wherein the (N)th stage further includes a holding portion configured to maintain the second node signal based at least in part on the first clock signal. In the above circuit, the first and second clock signals have a second logic level when the output control signal has a first logic level, wherein the first and second logic levels are respectively logical high and logical low levels.

Another aspect is a display device comprising a display panel including a plurality of gate lines, a plurality of data lines crossing the gate lines, and a plurality of pixels respectively connected to a selected one of the gate lines and a selected one of the data lines. The display device also comprises a data driver configured to transmit a plurality of data signals to the data lines, respectively. The display device also comprises a gate driver including a plurality of stages and configured to transmit a plurality of gate output signals to the gate lines, respectively and a timing controller configured to control the gate driver and the data driver. Each stage includes a first input portion configured to apply an input signal to a first node based at least in part on a first clock signal, a first output portion configured to output a second clock signal as a gate output signal based at least in part on a first node signal applied to the first node, a second input portion configured to apply the first clock signal to a second node based at least in part on the first node signal, a second output portion configured to output a first voltage as the gate output signal based at least in part on a second node signal applied to the second node, and an output control portion configured to activate the first output portion based at least in part on an output control signal.

In the above display device, the display panel can be foldable.

In the above display device, the timing controller is configured to output the output control signal having a first logic level and the first and second clock signals having a second logic level in non-display stages corresponding to a non-display region of the foldable display panel when the display panel is folded, wherein the first and second logic levels are respectively logical high and logical low levels.

In the above display device, the display panel can be flexible.

The above display device further comprises a flexibility detector configured to i) detect a non-display region of the flexible display panel and ii) transmit non-display region information relating to the non-display region to the timing controller, wherein the timing controller is further configured to output the output control signal having a first logic level and the first and second clock signals having a second logic level in non-display stages corresponding to the non-display region using the non-display region information, and wherein the first and second logic levels are respectively logical high and logical low levels.

In the above display device, the timing controller is further configured to output the output control signal having a first logic level and the first and second clock signals having a second logic level during a predetermined non-display period when image data included in the data signals is still image data, wherein the first and second logic levels are respectively logical high and logical low levels.

In the above display device, an (N)th stage represents a selected stage among the stages, wherein the (N)th stage further includes a stabilizing portion configured to substantially stabilize the (N)th gate output signal based at least in part on the second node signal and the second clock signal.

In the above display device, the stabilizing portion includes first and second stabilizing transistors connected to each other in series, wherein the first stabilizing transistor includes a gate electrode connected to the second node, a source electrode to which the first voltage is applied, and a drain electrode connected to a source electrode of the second stabilizing transistor, and wherein the second stabilizing transistor includes a gate electrode to which the second clock signal is applied, the source electrode connected to the drain electrode of the first stabilizing transistor, and a drain electrode connected to the first node.

In the above display device, an (N)th stage represents a selected stage among the stages, and wherein the (N)th stage further includes a holding portion configured to maintain the second node signal based at least in part on the first clock signal.

In the above display device, the holding portion includes a holding transistor, wherein the holding transistor includes a gate electrode to which the first clock signal is applied, a source electrode to which a second voltage is applied, and a drain electrode connected to the second node.

In the above display device, the first input portion includes a first input transistor, wherein the first input transistor includes a gate electrode to which the first clock signal is applied, a source electrode to which the input signal is applied, and a drain electrode connected to the first node.

In the above display device, an (N)th stage represents a selected stage among the stages, wherein the first output portion includes a first output transistor and a first capacitor, wherein the first output transistor includes a gate electrode connected to the first node, a source electrode to which the second clock signal is applied, and a drain electrode connected to an output terminal that is configured to output the (N)th gate output signal, and wherein the first capacitor includes a first electrode connected to the first node and a second electrode connected to the output terminal.

In the above display device, the second input portion includes a second input transistor, wherein the second input transistor includes a gate electrode connected to the first node, a source electrode to which the first clock signal is applied, and a drain electrode connected to the second node.

In the above display device, the second output portion includes a second output transistor and a second capacitor, wherein the second output transistor includes a gate electrode connected to the second node, a source electrode to which the first voltage is applied, and a drain electrode connected to an output terminal that outputs the (N)th gate output signal, and wherein the second capacitor includes a first electrode connected to the second node and a second electrode to which the first voltage is applied.

In the above display device, the output control portion includes an output control transistor, wherein the output control transistor includes a gate electrode to which the output control signal is applied, a source electrode to which a second voltage is applied, and a drain electrode connected to the first node.

Therefore, a gate driving circuit according to example embodiments can control the gate output signal based on the output control signal, thereby restricting the unnecessary gate output signal In addition, a display device according to example embodiments can inactivate a non-display region of the display panel and reduce the power consumption by including the gate driving circuit. Also, the display device can perform low frequency driving.

DETAILED DESCRIPTION OF CERTAIN INVENTIVE EMBODIMENTS

Recently, various types of displays have been developed such as foldable displays and flexible displays. These displays can be included in portable electronic devices, but they have limited usage time because the amount of power provided by on-board batteries is limited. Therefore, different ways to reduce power consumption are being developed to extend battery life.

Exemplary embodiments will be described more fully hereinafter with reference to the accompanying drawings, in which various embodiments are shown. In this disclosure, the term "substantially" includes the meanings of completely, almost completely or to any significant degree under some applications and in accordance with those skilled in the art. Moreover, "formed on" can also mean "formed over." The term "connected" can include an electrical connection.

Figure 1:
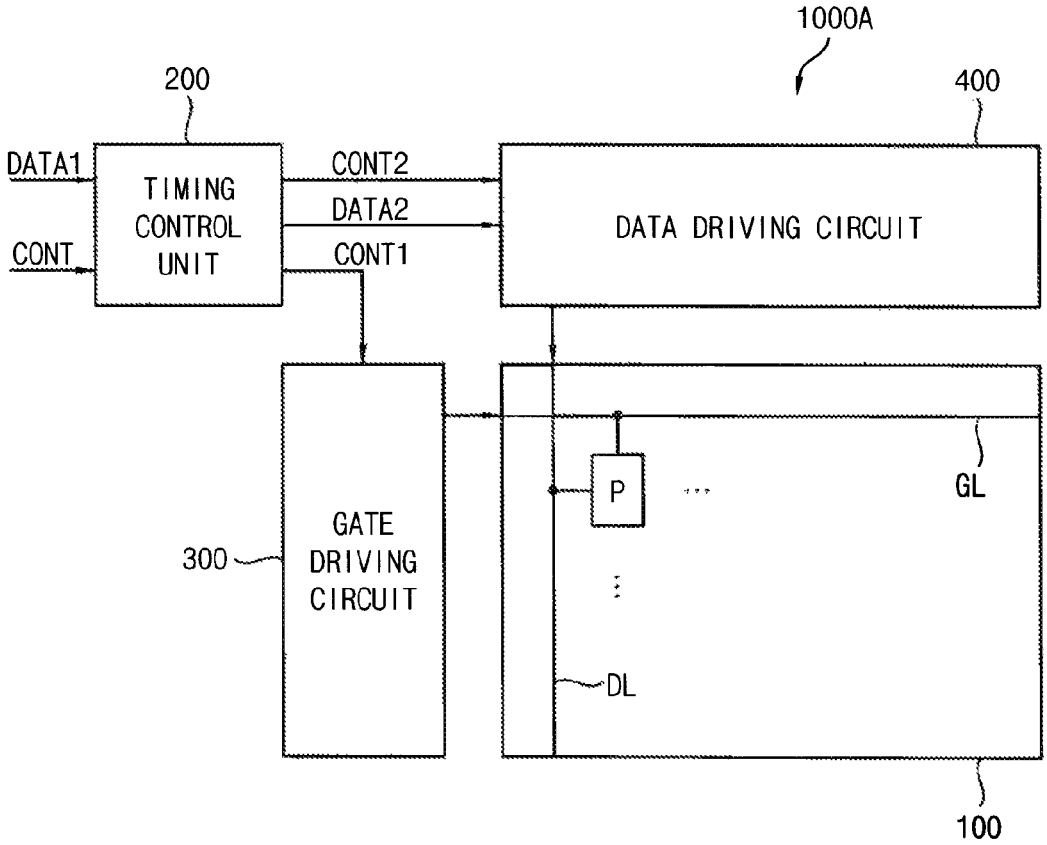
FIG. 1 is a block diagram illustrating an example of a display device according to example embodiments.

FIG. 1 is a block diagram illustrating an example of a display device according to example embodiments.

Referring to FIG. 1, a display device 1000A includes a display panel 100, a timing control unit or timing controller 200, a gate driving circuit or gate driver 300, and a data driving circuit or data driver 400. In one example embodiment, the display device 1000A is an organic light-emitting diode (OLED) display. In another example embodiment, the display device 1000A is a liquid crystal display (LCD).

The display panel 100 displays images. The display panel 100 includes a plurality of gate lines GL, a plurality of data lines DL crossing the gate lines, and a plurality of pixels P connected to the data lines and the gate lines. For example, the pixels P can be formed in a matrix. In one example embodiment, the number of the gate lines is n and the number of the data lines m, where n and m are positive integers. In one example embodiment, the number of the pixels P is n×m. In one example embodiment, each of pixel units includes three pixels P so that the number of the pixel units is n×m×⅓. In one example embodiment, the display panel 100 is a foldable display panel that is folded along at least one of folding line. In another example embodiment, the display panel 100 a flexible display panel.

The timing control unit 200 receives an input control signal CONT and input image signal DATA1 from an image source such as an external graphic device. The input control signal CONT can include a main clock signal, a vertical synchronizing signal, a horizontal synchronizing signal, a data enable signal, etc. The timing control unit 200 generates a first control signal CONT1 for controlling a driving timing of the gate driving circuit 300 and transmits the first control signal CONT1 to the gate driving circuit 300. Also, the timing control unit 200 generates a data signal DATA2 corresponding to operating conditions of the display panel 100 based at least in part on the input image signal DATA1 and transmits the data signal DATA2 to the data driving circuit 400. The timing control unit 200 generates a second control signal CONT2 for controlling a driving timing of the data driving circuit 400 and transmits the second control signal CONT2 to the data driving circuit 400.

The timing control unit 200 can control an output control signal, a first clock signal, and a second clock signal included in the first control signal CONT1 for controlling the display panel 100. In one example embodiment, the timing control unit 200 restricts the gate output signals in non-display stages corresponding to a non-display region of the display panel 100. For example, when the foldable display panel is folded, the timing control unit 200 outputs the output control signal having the first logic level (e.g., low level) and outputs the first and second clock signals having the second logic level (e.g., high level) in the non-display stages. When the display panel 100 is a flexible display panel, the timing control unit 200 outputs the output control signal having the first logic level and the first and second clock signals having the second logic level in the non-display stages based at least in part on the non-display region information. In another example embodiment, the timing control unit 200 controls the output control signal, the first clock signal, and the second clock signal by dividing a driving period into display periods and non-display periods so as to drive the display panel 100 with a low frequency. For example, the timing control unit 200 decides whether the image data is still image data by comparing the image data with previous image data. When the image data is the still image data, the timing control unit 200 outputs the output control signal having the first logic level and the first and second clock signals having the second logic level during the predetermined non-display periods.

The gate driving circuit 300 outputs the gate output signals to the gate lines GL based at least in part on the first control signal CONT1. The gate driving circuit 300 can include an output control part so as to control the gate output signals.

The data driving circuit 400 can convert the data signal DATA2 into the data voltage based at least in part on the second control signal CONT2 and apply the data voltage to the data lines DL.

In addition, the display device 1000A can further include a voltage generating unit (not shown). The voltage generating unit can receive an external voltage source and generate a gate driving voltage for driving the gate driving unit 300 based at least in part on the external voltage source. The voltage generating unit can output the gate driving voltage to the gate driving unit 300. The voltage generating unit can generate a data driving voltage for driving the data driving unit 400 based at least in part on the external voltage source and output the data driving voltage to the data driving unit 400. In one example embodiment, when the display device 1000A is the OLED display, the voltage generating unit can generate a first source voltage (e.g., ELVDD) and a second source voltage (e.g., ELVSS) to drive an OLED and output the first and second source voltages to the display panel 100. In another example embodiment, when the display device 1000A is the LCD, the voltage generating unit can generate a common voltage and a storage voltage and output the voltages to the display panel 100.

Therefore, the display device 1000A controls the gate output signal based at least in part on the output control signal, thereby limiting the unnecessary gate output signal. For example, the display device 1000A includes the foldable display panel or the flexible display panel and inactivates the non-display region of the display panel 100, thereby reducing the power consumption. In addition, the display device 1000A performs the low frequency driving when the image data is still image data.

Figure 2:
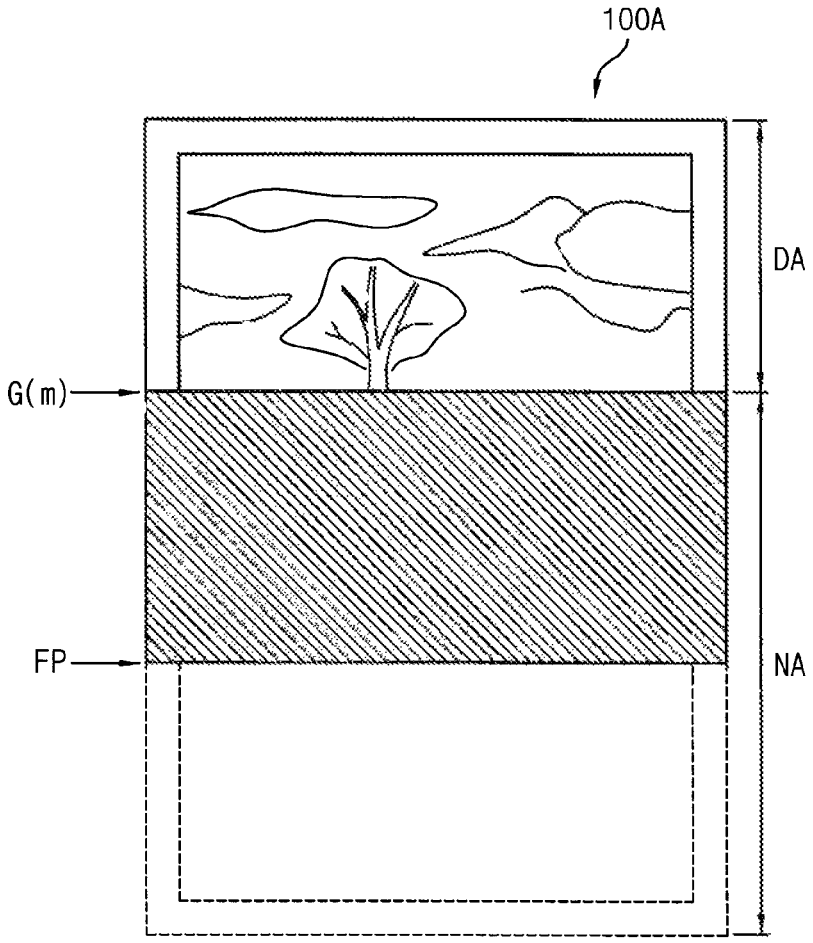
FIG. 2 is a diagram illustrating an example of controlling a gate output signal in non-display region of a display device of FIG. 1.

FIG. 2 is a diagram illustrating an example of controlling the gate output signal in the non-display region of a display device of FIG. 1.

Referring to FIG. 2, the display panel 100A is a foldable display panel that is folded along one or more folding lines. The foldable display panel can be folded along the folding line FP and can be separated into a display region DA and a non-display region NA.

A gate driving circuit can sequentially output gate output signals corresponding to the display region DA and restrict gate output signals corresponding to the non-display region NA. For example, in the display device having the foldable display panel and the gate driving circuit outputting the first gate output signal through the (N)th gate output signal, the foldable display panel is separated into the display region DA and the non-display region NA on the basis of the (M)th gate output signal. Thus, when the first through (M)th gate lines are connected to the display region DA and the (M+1)th through (N)th gate lines are connected to the non-display region NA, the gate driving circuit can sequentially output the first gate output signal through the (M)th gate output signal to display image in the display region DA. Also, the gate driving circuit can restrict the (M+1)th gate output signal through the (N)th gate output signal to not display an image in the non-display region NA. For example, the foldable display device senses that the foldable display panel is folded using a folding sensor. When the foldable display panel is folded, the timing control unit can control an output control signal, a first clock signal, and a second clock signal corresponding to a non-display region NA to not display the unnecessary image in the non-display region NA.

Figure 3:
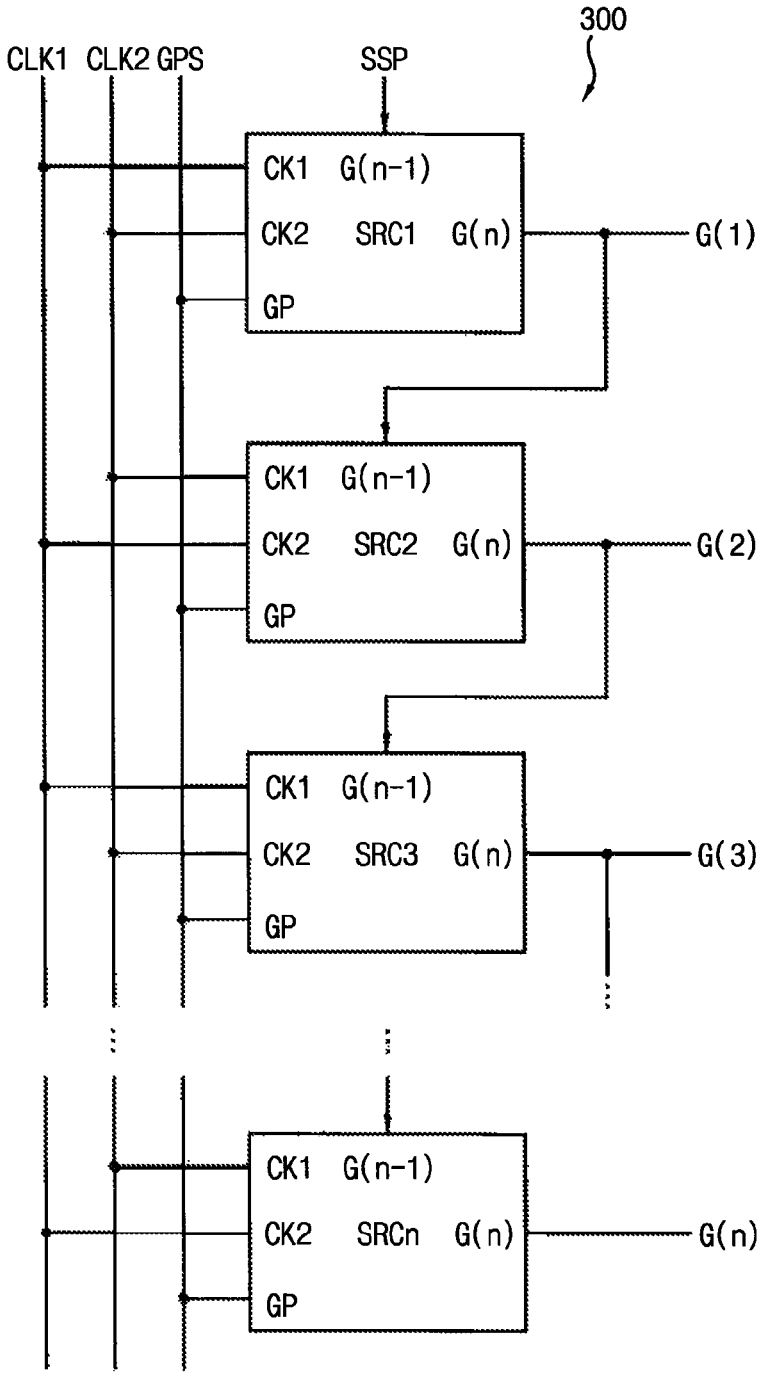
FIG. 3 is a block diagram illustrating an example of a gate driving circuit included in a display device of FIG. 1.
Figure 4:
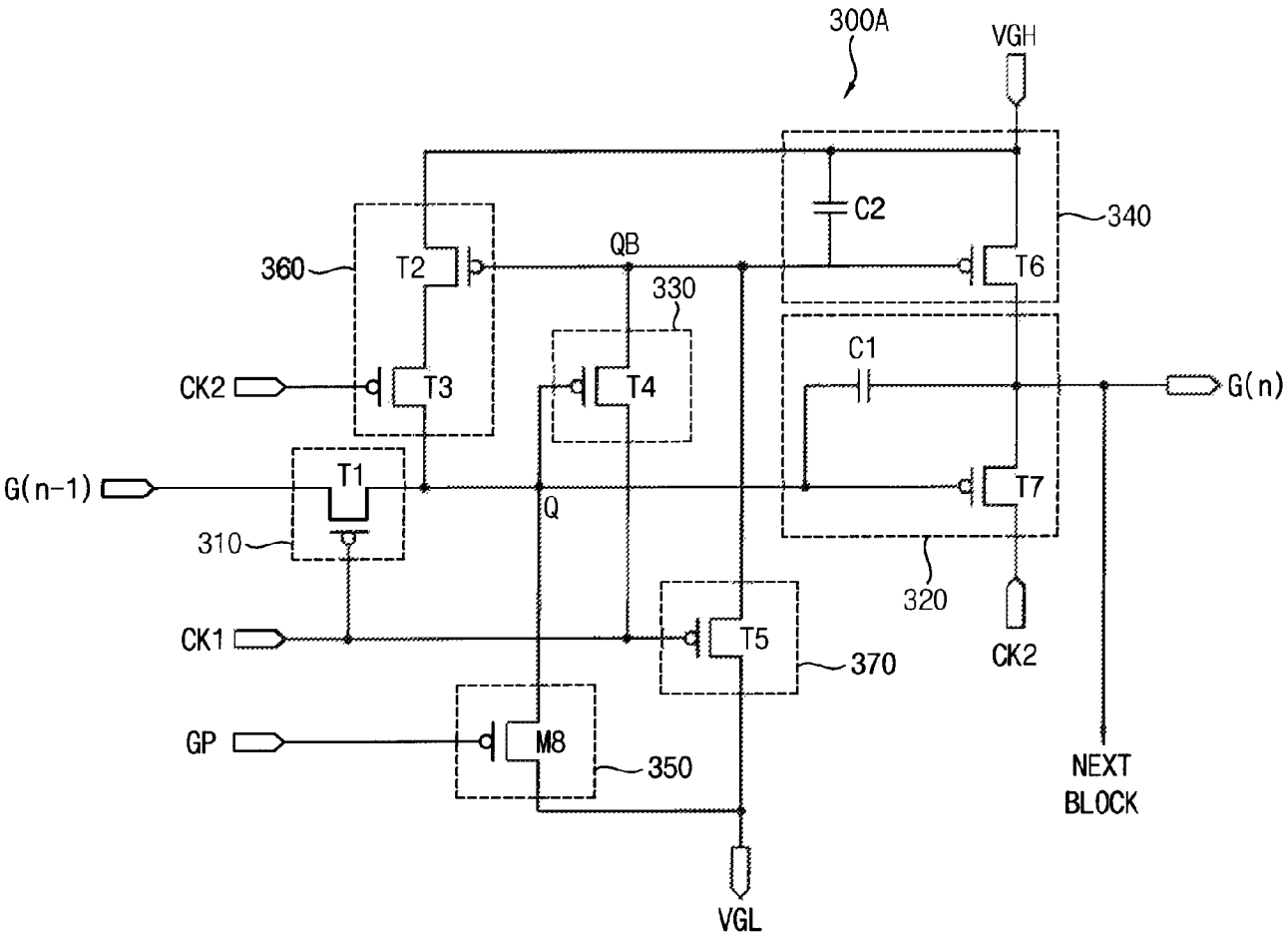
FIG. 4 is a circuit diagram illustrating an example of an (N)th stage included in a gate driving circuit of FIG. 3.
Figure 5:
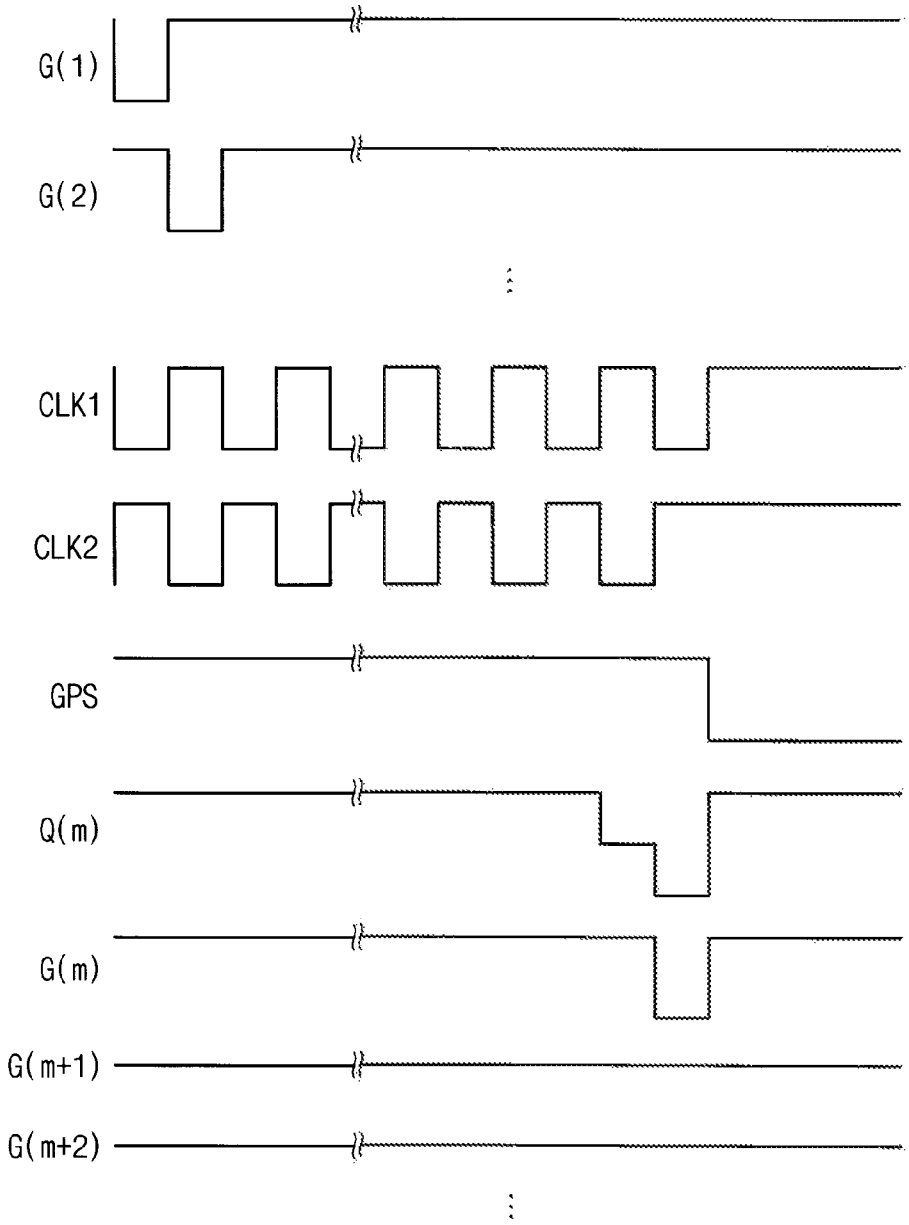
FIG. 5 is a waveform diagram illustrating an example of input signals, node signals, and output signals in a gate driving circuit of FIG. 3.

FIG. 3 is a block diagram illustrating an example of the gate driving circuit 300 included in a display device of FIG. 1. FIG. 4 is a circuit diagram illustrating an example of an (N)th stage included in the gate driving circuit 300 of FIG. 3. FIG. 5 is a waveform diagram illustrating an example of input signals, node signals, and output signals in a gate driving circuit of FIG. 3.

Referring to FIGS. 3 through 5, the gate driving circuit 300 include a plurality of stages SRC1 to SRCn that are connected to each other.

As shown in FIG. 3, each of the stages SRC1 to SRCn includes a first clock terminal CK1, a second clock terminal CK2, an output control terminal GP, an input terminal G(n−1), and an output terminal G(n). Also, each of the stages SRC1 to SRCn can further include a first voltage input terminal and a second voltage input terminal.

The first gate clock signal CLK1 and the second gate clock signal CLK2 having different timings are respectively applied to the first and second clock terminals CK1 and CK2. For example, the second gate clock signal CLK2 has a signal inverted from the first gate clock signal CLK1. In adjacent stages, the first and second gate clock signals CLK1 and CLK2 can be applied to the clock terminals in opposite sequences.

For example, the first gate clock signal CLK1 is applied to the first clock terminal CK1 of odd-numbered stages SRC1, SRC3, . . . when the second gate clock signal CLK2 is applied to the second clock terminal CK2 of the even-numbered stages SRC2, SRC4, . . . . In another example, the second gate clock signal CLK2 is applied to the first clock terminal CK1 of even-numbered stages SRC2, SRC4, . . . when the second gate clock signal CLK2 is applied to the second clock terminal CK2 of the odd-numbered stages SRC1, SRC3, . . . .

An output control signal GPS is applied to the output control terminal GP. The output control signal GPS can be substantially simultaneously applied to each output control terminal GP of all stages SRC1 to SRCn so as to control the overall display panel.

The vertical start signal SSP or the gate output signal of the previous stage can be applied to the input terminal G(n−1). Thus, the vertical start signal SSP is applied to the input terminal G(n−1) of the first stage SRC1. The gate output signals of the previous stages are respectively applied to each input terminal G(n−1) of the second through (n)th stages SRC2 through SRCn.

The output terminal G(n) outputs the gate output signal to the gate line electrically connected to the output terminal G(n). For example, the gate output signals G(1), G(3), . . . from the output terminal G(n) of the odd-numbered stages SRC1, SRC3, . . . is output in sync with a low signal of the second gate clock signal CLK2. Also, the gate output signals G(2), G(4), . . . from the output terminal G(n) of the even-numbered stages SRC2, SRC4, . . . is output in sync with a low signal of the first gate clock signal CLK1.

First and second voltages can be transmitted to the first and second voltage input terminals. For example, the first and second voltages are high level voltages.

As shown in FIG. 4, an (N)th stage 300A of the gate driving circuit includes a first input part 310, a first output part 320, a second input part 330, a second output part 340, an output control part 350, a stabilizing part 360, and a holding part 370. An input signal is applied to the input terminal G(n−1) of the (N)th stage 300A. A first clock signal is applied to the first clock terminal CK1. A second clock signal is applied to the second clock terminal CK2. A first voltage is applied to a first voltage input terminal VGH. A second voltage can be applied to a second voltage input terminal VGL. In some embodiments, when n is an odd number, the first clock signal is the first gate clock signal and the second clock signal is the second gate clock signal. When n is an even number, the first clock signal is the second gate clock signal and the second clock signal is the first gate clock signal. The (N)th stage 300A outputs the (N)th gate output signal to the output terminal G(n).

The first input part 310 applies the input signal to a first node Q in response to the first clock signal. The first input part 310 includes a first input transistor T1. The first input transistor T1 includes a gate electrode to which the first clock signal is applied, a source electrode to which the input signal is applied, and a drain electrode connected to the first node Q.

The first output part 320 outputs the second clock signal as the (N)th gate output signal in response to a first node signal applied to the first node Q. The first output part 320 adjusts the (N)th gate output signal to the first logic level in response to the first node signal. The first output part 320 includes a first output transistor T7 and a first capacitor C1. The first output transistor T7 includes a gate electrode connected to the first node Q, a source electrode to which the second clock signal is applied, and a drain electrode connected to an output terminal G(n) that outputs the (N)th gate output signal. The first capacitor C1 includes a first electrode connected to the first node Q and a second electrode connected to the output terminal G(n).

The second input part 330 applies the first clock signal to a second node QB in response to the first node signal. The second input part 330 includes a second input transistor T4. The second input transistor T4 includes a gate electrode connected to the first node Q, a source electrode to which the first clock signal is applied, and a drain electrode connected to the second node QB.

The second output part 340 outputs a first voltage as the (N)th gate output signal in response to a second node signal applied to the second node QB. The second output part 340 adjusts the (N)th gate output signal to the second logic level (e.g., high level) in response to the second node signal. The second output part 340 includes a second output transistor T6 and a second capacitor C2. The second output transistor T6 includes a gate electrode connected to the second node QB, a source electrode to which the first voltage is applied, and a drain electrode connected to an output terminal G(n) that outputs the (N)th gate output signal. The second capacitor C2 includes a first electrode connected to the second node QB and a second electrode to which the first voltage is applied.

The output control part 350 activates the first output part 320 in response to an output control signal. The output control part 350 includes an output control transistor T8. The output control transistor T8 includes a gate electrode to which the output control signal is applied, a source electrode to which a second voltage is applied, and a drain electrode connected to the first node Q. The output control signal is applied to the output control part 350 so as to restrict the gate output signal in all stages of the display device. In some embodiments, the first and second clock signals have the second logic level when the output control signal has the first logic level so as to restrict the gate output signal. Thus, the output control signal having the first logic level is applied to the output control part 350 so as to turn on the output control part 350 and to activate the first output part 320. When the first output part 320 is activated, thus the first output part 320 is turned on, the second clock signal having the second logic level is output as the (N)th gate output signal. For example, in the foldable display panel or the flexible display panel having the non-display region, the output control signal having the first logic level is output and the first and second clock signals having the second logic level is output in non-display stages corresponding to the non-display region. In another example, when the image data is the still image data, the output control signal having the first logic level and the first and second clock signals having the second logic level are output during a predetermined non-display period.

The stabilizing part 360 can substantially stabilize the (N)th gate output signal in response to the second node signal and the second clock signal. The stabilizing part 360 includes a first stabilizing transistor T2 and a second stabilizing transistor T3 that are connected to each other in series. The first stabilizing transistor T2 includes a gate electrode connected to the second node QB, a source electrode to which the first voltage is applied, and a drain electrode connected to a source electrode of the second stabilizing transistor T3. The second stabilizing transistor T3 includes a gate electrode to which the second clock signal is applied, the source electrode connected to the drain electrode of the first stabilizing transistor T2, and a drain electrode connected to the first node Q.

The holding part 370 can maintain the second node signal in response to the first clock signal. The holding part 370 includes a holding transistor T5. The holding transistor T5 includes a gate electrode to which the first clock signal is applied, a source electrode to which a second voltage is applied, and a drain electrode connected to the second node QB. For example, when the first clock signal has the second logic level, the holding transistor T5 is turned off. When the first clock signal has the first logic level, the holding transistor T5 is turned on, thereby maintaining voltage of the second node QB to the second voltage.

As shown in FIG. 5, the output control signal GPS, the first gate clock signal CLK1, and the second gate clock signal CLK2 are controlled so as to restrict the gate output signals G(m+1) through G(n) corresponding to stages of the non-display region.

In the first through (m)th stages corresponding to stages of the display region among the first through the (n)th stages, the output control signal GPS can have the second logic level (e.g., high level), and the first and second gate clock signals CLK1 CLK2 can have clock signals having different timings. Therefore, the first through (m)th gate output signals G(1), G(2), G(m) are sequentially output and images corresponding to the image data is displayed in the display region.

In some embodiments, in the (m+1)th through (n)th stages corresponding to stages of the display region, the output control signal GPS has the first logic level, and the first and second gate clock signals CLK1 CLK2 have the second logic level. The (m+1)th through (n)th gate output signals are restricted so as to not display an image in the non-display region.

Therefore, the display device can reduce the power consumption, because the image is not displayed in the non-display region. Thus, the display device does not need to generate the clock signals in stages corresponding to the non-display region because the first and second gate clock signal CLK1 CLK2 are maintained at the second logic level. Therefore, the number of internal charging can be reduced. In addition, when the display device is an OLED display, OLEDs are not emitted in the non-display region by restricting the gate output signals corresponding to the non-display region. Therefore, the output control signal GPS, the first gate clock signal CLK1, and the second gate clock signal CLK2 are controlled, and therefore, the display panel does not display in the non-display region so as to reduce the power consumption.

Figure 6:
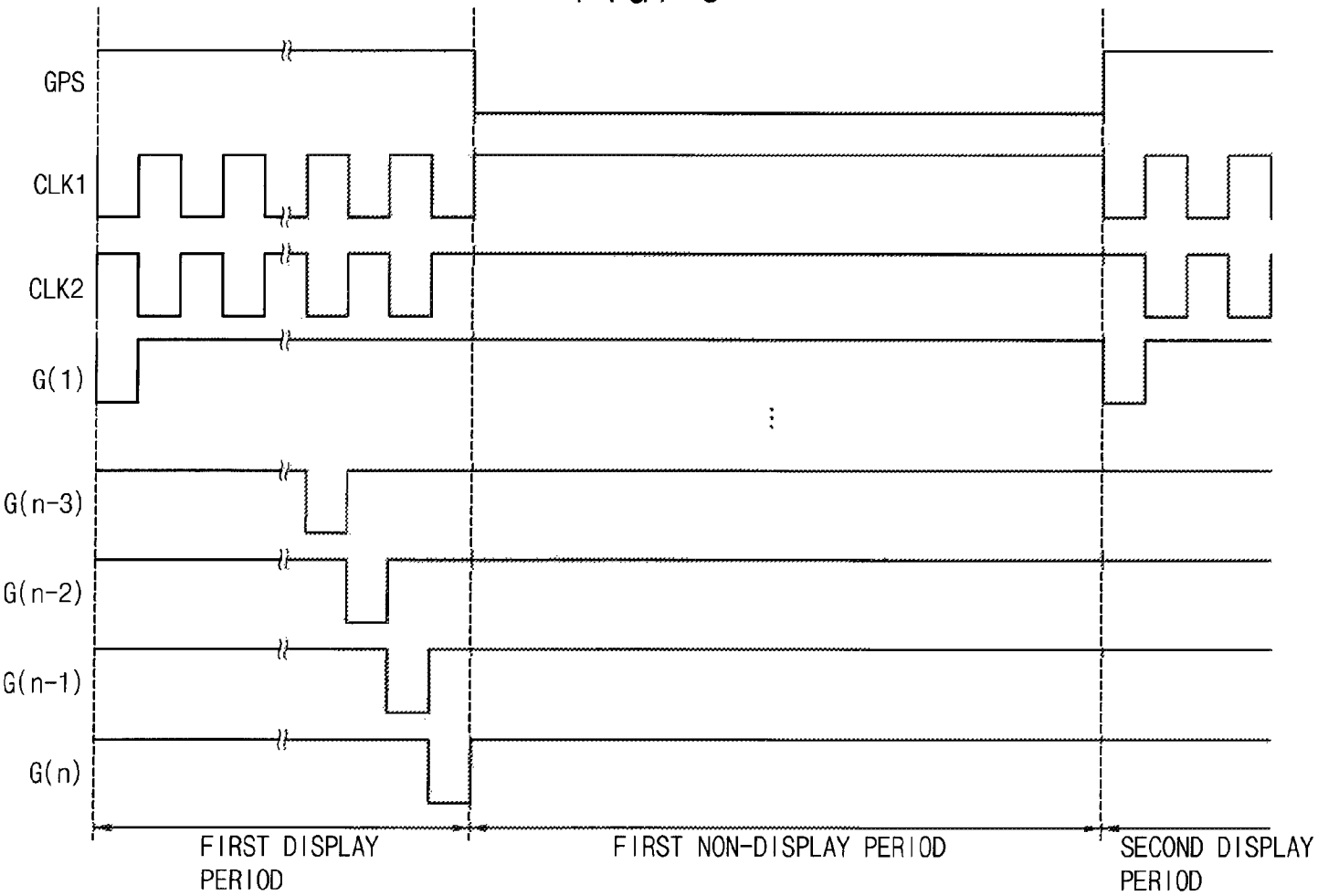
FIG. 6 is a waveform diagram illustrating another example of input signals, node signals, and output signals in a gate driving circuit of FIG. 3.

FIG. 6 is a waveform diagram illustrating another example of input signals, node signals, and output signals in a gate driving circuit of FIG. 3.

Referring to FIG. 6, an output control signal GPS having the first logic level is outputted and the first and second gate clock signals CLK1 and CLK2 having the second logic level are output during a predetermined non-display period when image data is still image data. Thus, the display device can perform low frequency driving while the still image data is output by controlling the output control signal GPS, the first gate clock signal CLK1 and second gate clock signal CLK2.

For example, the output control signal can be maintained to the second logic level and the first and second gate clock signals CLK1 and CLK2 can have clock signals having different timings during the first display period. Therefore, the first through (m)th gate output signals G(1), G(2), . . . G(m) are sequentially output and images corresponding to the image data is displayed in the display region. Thereafter, the output control signal GPS having the first logic level is output, and the first and second gate clock signals CLK1 and CLK2 having the second logic level are output to drive the display panel with low frequency during the predetermined second non-display period. The display device can perform the low frequency driving by the display periods and the non-display periods that are alternately arranged. Here, lengths of the non-display periods are adjusted to prevent the flicker. The flicker can occur according to a size or type of the display panel or gray scale of the image data. In some embodiments, lengths of the non-display periods are adjusted according to the display panel. The length of the non-display period is substantially equal to the length of the display period. For example, in the display device outputting 60 frame data per one second, the display device outputs 30 frame data per one second when the image data is the still image data. In other embodiments, the length of the non-display period is dynamically adjusted according to the grayscale of the image data.

Figure 7:
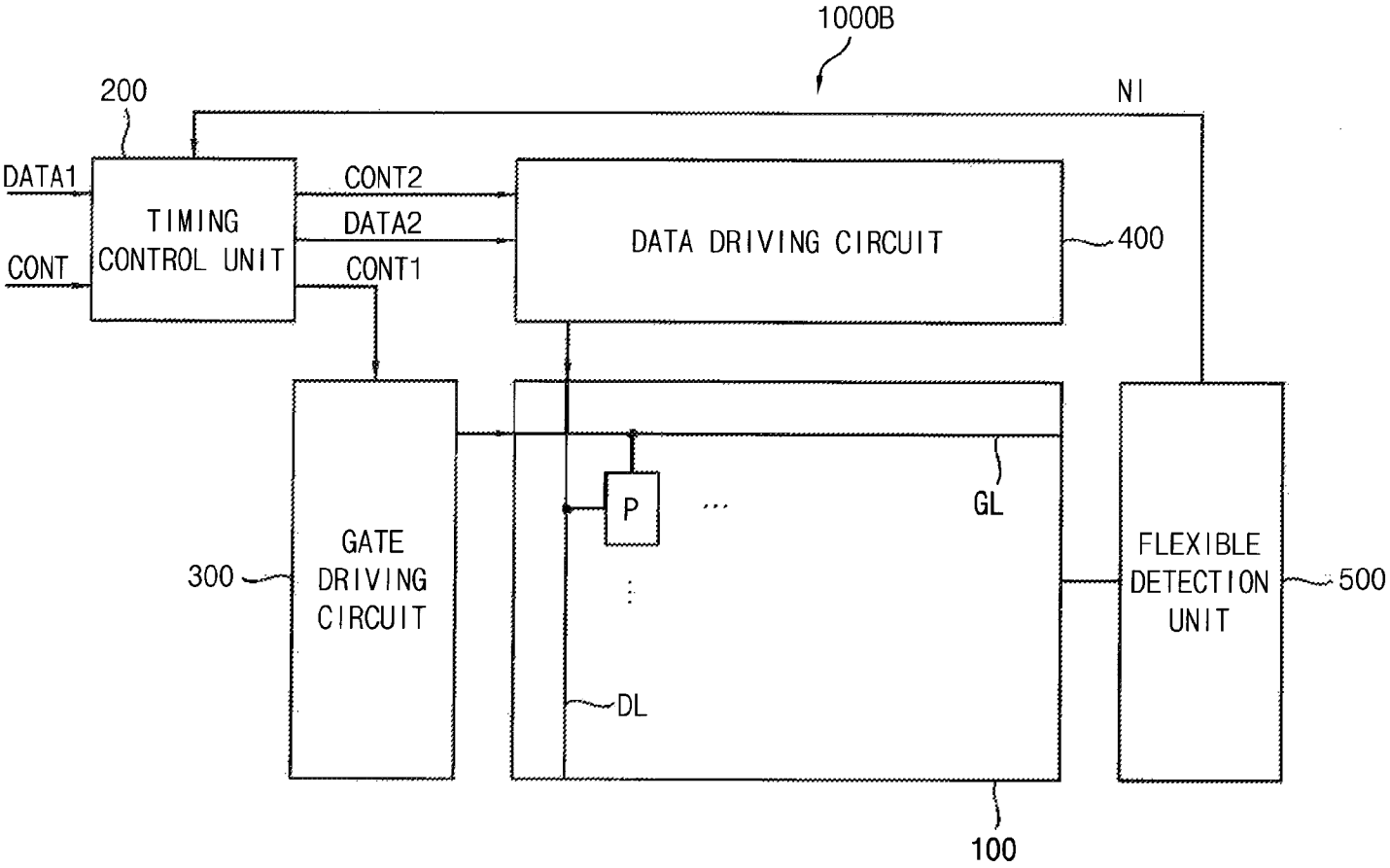
FIG. 7 is a block diagram illustrating another example of a display device according to example embodiments.

FIG. 7 is a block diagram illustrating another example of a display device according to example embodiments.

Referring to FIG. 7, a display device 1000B includes a display panel 100, a timing control unit 200, a gate driving circuit 300, a data driving circuit 400, and a flexible detection unit or flexibility detector 500. The display device 1000B according to the present exemplary embodiment is substantially the same as the display device 1000A of the exemplary embodiment described in FIG. 1, except that the flexible detection unit 500 is added. Therefore, the same reference numerals will be used to refer to the same or like parts as those described in the previous exemplary embodiment of FIG. 1, and any repetitive explanation concerning the above elements will be omitted.

The display panel 100 displays images. The display panel 100 includes a plurality of gate lines GL, a plurality of data lines DL crossing the gate lines, and a plurality of pixels P connected to the data lines and the gate lines. The display panel 100 can be a flexible display panel. The display panel 100 can be wound or bent. In one example embodiment, the flexible display panel is wound by one roller. In another example embodiment, the flexible display panel is wound by a plurality of rollers.

The timing control unit 200 receives an input control signal CONT and input image signal DATA1 from an image source such as an external graphic device. The timing control unit 200 generates a first control signal CONT1 for controlling a driving timing of gate driving circuit 300 and transmits the first control signal CONT1 to the gate driving circuit 300. Also, the timing control unit 200 can generate a data signal DATA2 corresponding to operating conditions of the display panel 100 based on the input image signal DATA1 and transmit the data signal DATA2 to the data driving circuit 400. The timing control unit 200 can generate a second control signal CONT2 for controlling a driving timing of data driving circuit 400 and transmit the second control signal CONT2 to the data driving circuit 400.

The timing control unit 200 controls an output control signal, a first clock signal, and a second clock signal included in the first control signal CONT1 for controlling the display panel 100. The timing control unit 200 can detect the non-display region using the non-display region information NI received from the flexible detection unit 500. The timing control unit 200 can output the output control signal having the first logic level and the first and second clock signals having the second logic level in non-display stages corresponding to the non-display region.

The gate driving circuit 300 can output the gate output signals to the gate lines GL based at least in part on the first control signal CONT1 received from the timing control unit 200. The gate driving circuit 300 can include an output control part to control the gate output signal based on the output control signal.

The data driving circuit 400 can convert the data signal DATA2 received from the timing control unit 200 into the data voltage based on the second control signal CONT2 received from the timing control unit 200 and apply the data voltage to the data lines DL.

The flexible detection unit 500 can detect the non-display region of the flexible display panel and generate non-display region information NI corresponding to the non-display region. The flexible detection unit 500 transmits the non-display region information NI to the timing control unit 200. The flexible detection unit 500 can detect a bending status of the display panel 100 when the display device 1000B is bent or wound. In one example embodiment, the flexible detection unit 500 can include one or more bend sensors formed on the display panel 100. The bend sensor is bendable. A resistance value of the bend sensor changes according to a degree of bending. The bend sensor can be a various type of sensor such as fiber-optic bend sensors, pressure sensor, strain gauge, etc. When the display panel 100 is bent, the band sensor is also bent. The bend sensor can output the resistance value according to an intensity of tension. Thus, the flexible detection unit 500 can obtain the resistance value of the bend sensor using the voltage or current applied to the bend sensor and can detect the bending status according to the resistance value, thereby detecting the non-display region. The flexible detection unit 500 can provide the non-display region information NI relating to the non-display region to the timing control unit 200. The non-display region information NI can include various information about the bending status, such as the position of the non-display region, bending duration time, etc.

In addition, the display device 1000B can further include the voltage generating unit.

Figure 8:
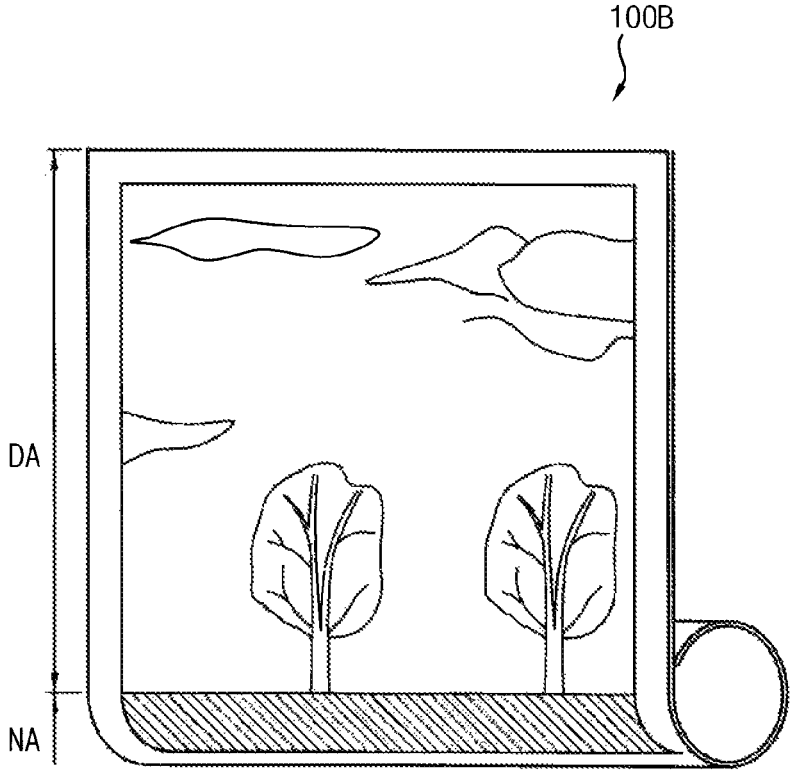
FIG. 8 is a diagram illustrating an example of controlling a gate output signal in non-display region of a display device of FIG. 7.

FIG. 8 is a diagram illustrating an example of controlling a gate output signal in the non-display region of a display device of FIG. 7.

Referring to FIG. 8, the display panel 100B can be a flexible display panel. The flexible display panel can be separated into a display region DA and a non-display region NA.

A gate driving circuit included in the display device can sequentially output gate output signals corresponding to the display region DA and can restrict gate output signals corresponding to the non-display region NA. Thus, in the gate driving circuit outputting the first gate output signal through the (N)th gate output signal, when the first through (M)th gate lines are connected to the display region DA and the (M+1)th through (N)th gate lines are connected to the non-display region NA, the gate driving circuit can sequentially output the first gate output signal through the (M)th gate output signal to display the image in the display region DA. Also, the gate driving circuit can restrict the (M+1)th gate output signal through the (N)th gate output signal to not display the image in the non-display region NA. For example, the flexible display device can detect the non-display region NA using the bend sensor when the flexible display is bent or wound. The timing control unit can control an output control signal, a first clock signal, and a second clock signal corresponding to a non-display region NA to not display the image in the non-display region NA.

The described technology can be applied to an electronic device having a display device. For example, the described technology can be applied to a television, a computer monitor, a laptop, a cell phone, a smartphone, a tablet personal computer (PC), a personal digital assistant (PDA), a portable multimedia player (PMP), an MP3 player, a navigation system, a game console, a video phone, etc.

The foregoing is illustrative of embodiments and is not to be construed as limiting thereof. Although a few embodiments have been described, those skilled in the art will readily appreciate that many modifications are possible in the embodiments without materially departing from the novel teachings and advantages of the inventive technology. Accordingly, all such modifications are intended to be included within the scope of the inventive concept as defined in the claims. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims.

What is claimed is:

1. A gate driving circuit for a display device, comprising:

a plurality of stages configured to respectively output a plurality of gate output signals, each stage comprising:

a first input portion configured to apply an input signal to a first node based at least in part on a first clock signal;

a first output portion configured to output a second clock signal as a gate output signal based at least in part on a first node signal applied to the first node;

a second input portion configured to apply the first clock signal to a second node based at least in part on the first node signal;

a second output portion configured to output a first voltage as the gate output signal based at least in part on a second node signal applied to the second node; and an output control portion configured to activate the first output portion based at least in part on an output control signal, wherein the display device comprises:

a flexible display panel electrically connected to the gate driving circuit;

a timing controller electrically connected to the gate driving circuit;

a flexibility detector configured to i) detect a non-display region of the flexible display panel and ii) transmit non-display region information relating to the non-display region to the timing controller, wherein the timing controller is configured to output the output control signal having a first logic level and the first and second clock signals having a second logic level in non-display stages corresponding to the non-display region using the non-display region information, and wherein the first and second logic levels are respectively logical high and logical low levels.

2. The gate driving circuit of claim 1, wherein an (N)th stage represents a selected stage among the stages, and wherein the (N)th stage further includes:

a stabilizing portion configured to substantially stabilize the (N)th gate output signal based at least in part on the second node signal and the second clock signal.

3. The gate driving circuit of claim 2, wherein the stabilizing portion includes first and second stabilizing transistors connected to each other in series, wherein the first stabilizing transistor includes a gate electrode connected to the second node, a source electrode to which the first voltage is applied, and a drain electrode connected to a source electrode of the second stabilizing transistor, and wherein the second stabilizing transistor includes a gate electrode to which the second clock signal is applied, the source electrode connected to the drain electrode of the first stabilizing transistor, and a drain electrode connected to the first node.

4. The gate driving circuit of claim 1, wherein an (N)th stage represents a selected stage among the stages, and wherein the (N)th stage further includes:

a holding portion configured to maintain the second node signal based at least in part on the first clock signal.

5. A display device comprising:

a display panel including a plurality of gate lines, a plurality of data lines crossing the gate lines, and a plurality of pixels respectively connected to a selected one of the gate lines and a selected one of the data lines;

a data driver configured to transmit a plurality of data signals to the data lines, respectively;

a gate driver including a plurality of stages and configured to transmit a plurality of gate output signals to the gate lines, respectively; and a timing controller configured to control the gate driver and the data driver, wherein each stage includes:

a first input portion configured to apply an input signal to a first node based at least in part on a first clock signal;

a first output portion configured to output a second clock signal as a gate output signal based at least in part on a first node signal applied to the first node;

a second input portion configured to apply the first clock signal to a second node based at least in part on the first node signal;

a second output portion configured to output a first voltage as the gate output signal based at least in part on a second node signal applied to the second node; and an output control portion configured to activate the first output portion based at least in part on an output control signal, wherein the display panel is flexible;

wherein the display device further comprises a flexibility detector configured to i) detect a non-display region of the flexible display panel and ii) transmit non-display region information relating to the non-display region to the timing controller, wherein the timing controller is further configured to output the output control signal having a first logic level and the first and second clock signals having a second logic level in non-display stages corresponding to the non-display region using the non-display region information, and wherein the first and second logic levels are respectively logical high and logical low levels.

6. The display device of claim 5, wherein the display panel is foldable.

7. A display device, comprising:

a display panel including a plurality of gate lines, a plurality of data lines crossing the gate lines, and a plurality of pixels respectively connected to a selected one of the gate lines and a selected one of the data lines;

a data driver configured to transmit a plurality of data signals to the data lines, respectively;

a gate driver including a plurality of stages and configured to transmit a plurality of gate output signals to the gate lines, respectively; and a timing controller configured to control the gate driver and the data driver, wherein each stage includes:

a first input portion configured to apply an input signal to a first node based at least in part on a first clock signal;

a first output portion configured to output a second clock signal as a gate output signal based at least in part on a first node signal applied to the first node;

a second input portion configured to apply the first clock signal to a second node based at least in part on the first node signal;

a second output portion configured to output a first voltage as the gate output signal based at least in part on a second node signal applied to the second node; and an output control portion configured to activate the first output portion based at least in part on an output control signal, wherein the display panel is foldable, and wherein the timing controller is configured to output the output control signal having a first logic level and the first and second clock signals having a second logic level in non-display stages corresponding to a non-display region of the foldable display panel when the display panel is folded, and wherein the first and second logic levels are respectively logical high and logical low levels.

8. The display device of claim 5, wherein the timing controller is further configured to output the output control signal having a first logic level and the first and second clock signals having a second logic level during a predetermined non-display period when image data included in the data signals is still image data, and wherein the first and second logic levels are respectively logical high and logical low levels.

9. The display device of claim 5, wherein an (N)th stage represents a selected stage among the stages, and wherein the (N)th stage further includes:

a stabilizing portion configured to substantially stabilize the (N)th gate output signal based at least in part on the second node signal and the second clock signal.

10. The display device of claim 9, wherein the stabilizing portion includes first and second stabilizing transistors connected to each other in series, wherein the first stabilizing transistor includes a gate electrode connected to the second node, a source electrode to which the first voltage is applied, and a drain electrode connected to a source electrode of the second stabilizing transistor, and wherein the second stabilizing transistor includes a gate electrode to which the second clock signal is applied, the source electrode connected to the drain electrode of the first stabilizing transistor, and a drain electrode connected to the first node.

11. The display device of claim 5, wherein an (N)th stage represents a selected stage among the stages, and wherein the (N)th stage further includes:

a holding portion configured to maintain the second node signal based at least in part on the first clock signal.

12. The display device of claim 11, wherein the holding portion includes a holding transistor, and wherein the holding transistor includes a gate electrode to which the first clock signal is applied, a source electrode to which a second voltage is applied, and a drain electrode connected to the second node.

13. The display device of claim 5, wherein the first input portion includes a first input transistor, and wherein the first input transistor includes a gate electrode to which the first clock signal is applied, a source electrode to which the input signal is applied, and a drain electrode connected to the first node.

14. The display device of claim 5, wherein an (N)th stage represents a selected stage among the stages, wherein the first output portion includes a first output transistor and a first capacitor, wherein the first output transistor includes a gate electrode connected to the first node, a source electrode to which the second clock signal is applied, and a drain electrode connected to an output terminal that is configured to output the (N)th gate output signal, and wherein the first capacitor includes a first electrode connected to the first node and a second electrode connected to the output terminal.

15. The display device of claim 5, wherein the second input portion includes a second input transistor, and wherein the second input transistor includes a gate electrode connected to the first node, a source electrode to which the first clock signal is applied, and a drain electrode connected to the second node.

16. The display device of claim 5, wherein the second output portion includes a second output transistor and a second capacitor, wherein the second output transistor includes a gate electrode connected to the second node, a source electrode to which the first voltage is applied, and a drain electrode connected to an output terminal that outputs the (N)th gate output signal, and wherein the second capacitor includes a first electrode connected to the second node and a second electrode to which the first voltage is applied.

17. The display device of claim 5, wherein the output control portion includes an output control transistor, and wherein the output control transistor includes a gate electrode to which the output control signal is applied, a source electrode to which a second voltage is applied, and a drain electrode connected to the first node.

* * * * *